United States Patent [19]

Capdebosco et al.

[11] Patent Number: 4,506,875

[45] Date of Patent: Mar. 26, 1985

[54] SUCTION-BOX FEED DEVICE

[75] Inventors: Bernard Capdebosco, St Just Chaleyssin; Jean-Luc Mion, St Victor de Cessieu, both of France

[73] Assignee: S. A. Martin, Villeurbanne, France

[21] Appl. No.: 452,478

[22] Filed: Dec. 23, 1982

[30] Foreign Application Priority Data

Feb. 19, 1982 [FR] France ..... 82 02907

[51] Int. Cl.[3] ..... B65H 3/08

[52] U.S. Cl. ..... 271/99; 271/132

[58] Field of Search ..... 271/99, 102, 132, 100, 271/101, 90, 131

[56] References Cited

U.S. PATENT DOCUMENTS 3,202,420 8/1965 Dovey ..... 294/64.1

3,724,687 4/1973 Marschke ..... 294/64.1

3,844,551 10/1974 Morrison ..... 271/99

FOREIGN PATENT DOCUMENTS 1443077 7/1976 United Kingdom ..... 271/99

*Primary Examiner*—Richard A. Schacher

*Attorney, Agent, or Firm*—Pollock, Vande Sande & Priddy

[57] ABSTRACT

Feeder with a movable suction box, intended more particularly for equipping a magazine supplying sheets to a machine for making cases consisting of corrugated cardboard. The suction plate (10) of its suction box (6) is surrounded by a frame (17) made of flexible material, the assembly being designed in such a way so as to form a suction cup with flexible edges (26).

4 Claims, 4 Drawing Figures

SUCTION-BOX FEED DEVICE

FIELD OF THE INVENTION

The present invention relates to a feeder with a movable suction box, intended more particularly for equipping a magazine supplying sheets to a machine for cases consisting of making cases consisting of corrugated cardboard cases.

BACKGROUND OF THE INVENTION

Feeders with a movable suction box, called "suction feeders", are in very widespread use in the industry for making corrugated cardboard cases and are described in many patents, such as, for example, French Nos. 1,343,103 and 1,568,091.

All these devices make use of one or more suction boxes which are movable in a longitudinal direction and the upper part of which is shut off by a horizontal plate which is provided with holes and transmits the vacuum to the sheet, and which thus makes it possible to grasp the cardboard for at least part of the extraction cycle.

These known devices are not always satisfactory, especially in the processing of sheets made of hard carboard. In fact, it is noted that the curved sheets are often laid on the suction box or boxes only partially, so that some sheets which are insufficiently flattened do not pass under the feeder blade, thus resulting in cramming which requires manual intervention by an operator.

To mitigate this type of disadvantage, it has already been suggested to use auxiliary telescopic suction cups, but such device involves a relatively high production and maintenance cost, so that a simpler and less expensive solution seems desirable.

SUMMARY OF THE INVENTION

The object of the present invention is a suction feeder of high efficiency and with simple, reliable and inexpensive production. It is characterized in that at least part of the suction plate of its suction box or at least one of its suction boxes is associated with a frame or the like, made of flexible material, which surrounds it in such a way as to form with it a hollow suction cup, the flexible edges of which are located above the upper level of the said plate or plate portion in the absence of a sheet sucked up, i.e., when the said edges are raised, and conversely are in alignment with or below the said upper level of the said plate or plate portion when a sheet is sucked up, i.e., when the said edges are turned down.

In a preferred embodiment, each suction plate equipping the box or boxes is surrounded by a thin frame made of flexible material, which forms an acute angle with the plane of the said plate towards the outside of the latter, this suction plate being positioned at a level higher than, preferably slightly higher than that of the table on which it is fastened. Advantageously, moreover, the material constituting this thin frame consists of a coating of plastic or the like, bonded to a cloth, such as a woven-nylon cloth, the cloth side being positioned towards the top, i.e., on the same side as the cardboard sheet to be sucked up. In practice, this frame can be cut out from a sheet of certain materials intended for making belts.

BRIEF DESCRIPTION OF THE DRAWINGS

The invention will be understood better by means of the following description of a preferred embodiment, with reference to the attached drawings in which.

DETAILED DESCRIPTION

Figures 1, 2:
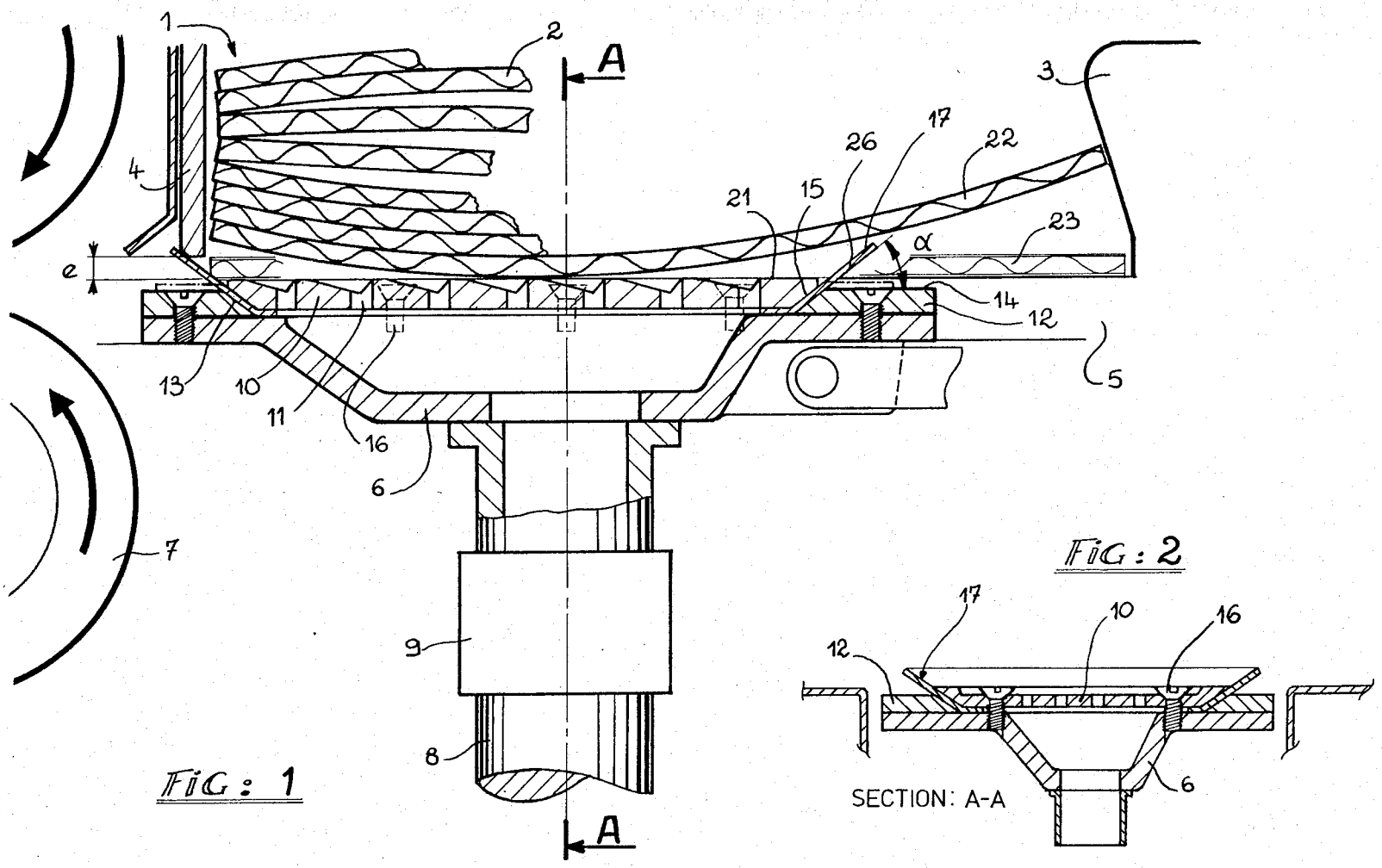
FIG. 1 is a diagrammatic view in longitudinal section of the feeder of the invention.
FIG. 2 is a diagrammatic section view, on a reduced scale, along the line A—A of FIG. 1.
Figure 4:
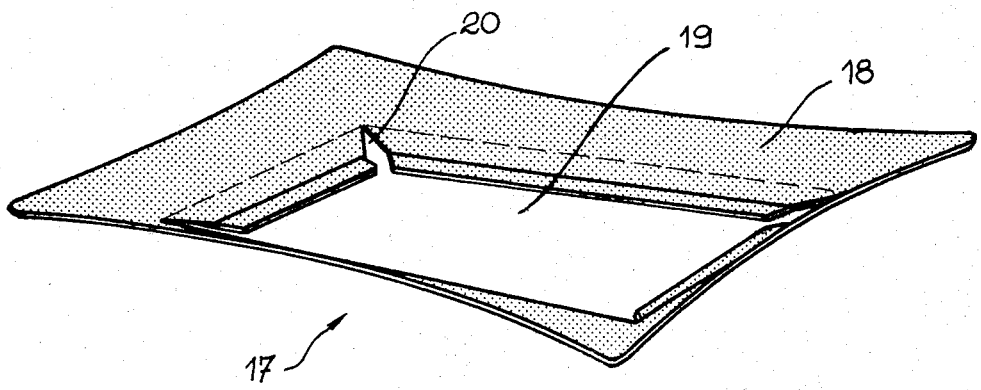
FIG. 4 is a perspective view of the same frame after it has been put in place on the feeder.

Referring, first of all, to FIGS. 1 and 2 as a whole, the feeder illustrated is a feeder closely resembling that described in French Pat. No. 1,343,103 (or U.S. Pat. No. 3,226,108) mentioned above. It comprises, in particular, a magazine 1 which contains the stack 2 of sheets made of corrugated cardboard, to be extracted one by one from the bottom of the said stack, and which is delimited at the rear by a stop 3 adjustable as a function of the size of the sheets and at the front by the feeder blade 4 which defines together with the feed table 5 a space e sufficient to allow one cardboard sheet and one only to pass.

The function of a suction box 6, driven in a longitudinal to-and-fro movement by conventional means (not shown), is to pick up the lower sheet of the stack 2 and cause it to advance under the blade 4 until the drive rollers 7 located downstream have taken over. For this purpose, the box 6 is connected to a vacuum source (not shown) by means of a pipe 8 and an electromagnetic distribution valve 9. In a conventional manner, the electromagnetic valve 9 is controlled in such a way that the vacuum is applied to the box 6 during the phase in which it picks up and advances the lower sheet of the stack, and is released during the phase in which the said box is retracted. Also in a conventional way, the vacuum is applied to the lower sheet via a horizontal plate 10 which is provided with holes 11 and the surface of which advantageously has the form of sawtooth corrugations clearly evident in FIG. 1.

According to the invention, an orifice 13, for example of rectangular shape, is cut out from the plate 12 forming the upper periphery of the body of the box 6, so as to form a bottomless dish, the edges of which form with the upper face of the periphery of plate 12 an acute angle $\alpha$ advantageously of the order of 45°, as may be seen clearly in FIGS. 1 and 2.

The edges of the suction plate 10 are cut out in such a way as to have a shape complementary to that of the edges 13 of the peripheral plate 12.

The plate 10 is intended to be screwed to the body of the box 6 by means of the screws 16, fitting closely into the bottomless dish 13. Located between the two is a flat thin continuous gasket 17 made of flexible material, which projects freely from the edges of the dish 13 as an extension of these, as may be seen in the drawings, so as to form together with the suction plate 10 a suction cup with edges 26 raised upwards and forming an acute angle $\alpha$ with the horizontal.

Figure 3:
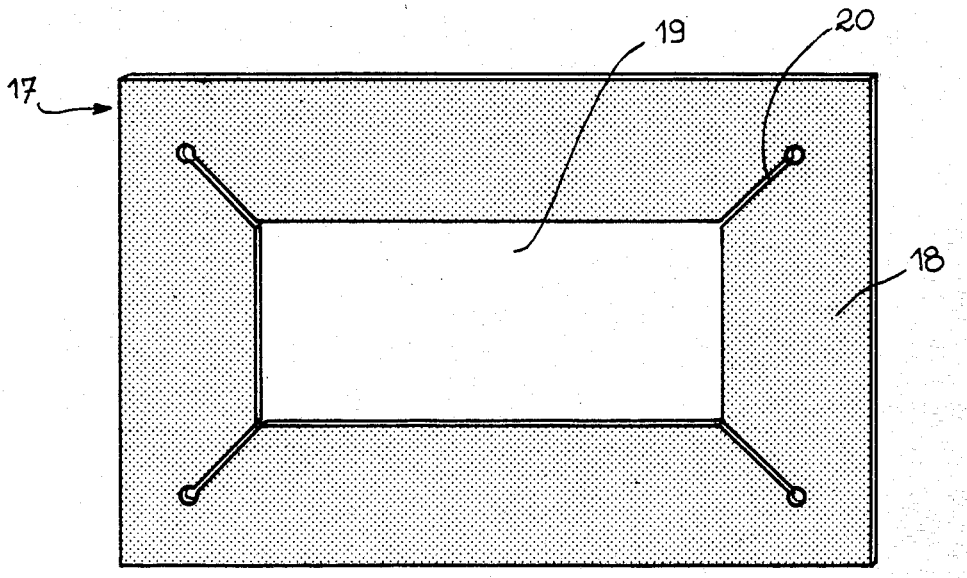
FIG. 3 is a plan view of the flexible frame used for the feeder of FIG. 1, before it is installed on the latter.

In the embodiment described, the gasket 17 consists, at the outset, of a flat frame 18, shown in FIG. 3, which is provided with a central orifice, at the four corners of which 45° slits 20 are cut out. Many flexible materials ranging from metal foil to elastomer can be used for forming the gasket 17. The applicant found that excellent results were obtained by using sheet material for belts, consisting conventionally of a woven-nylon cloth to which a sheet of plastic is bonded, and by fitting the gasket 17 in such a way that the cloth is located towards the top i.e., that it faces the stack 2, or towards the inside of the suction cup 10, 17.

As may be seen in FIGS. 1 and 2 and above all 4, screwing suction plate 10 onto peripheral plate 12, with the gasket 17 between them, causes the center of the frame 18 to penetrate into the orifice 13 and its edges to be raised at the angle $\alpha$, so as to form together with the plate 10 a dish with flexible edges.

Moreover, the thickness of the suction plate 10 and that of the flexible frame 17 are determined in relation to peripheral plate 12 in such a way that the upper face 21 of the plate 10 is located above the upper face 14 of plate 12 with a height difference at least equal to the thickness of the frame 17. In this way, the flexible frame 17 will never have to support the weight of the stack 2.

The device of the invention operates as follows:

When a vacuum is applied to a curved sheet 22, leakage is limited by the edges of the flexible frame 17, and the assembly (10,17) behaves like a hollow suction cup which sucks up the sheet 22 positively and straightens it at 23, while the frame 17 is folded down on peripheral plate 12, as may be seen in FIG. 1. The straightened sheet 23 can therefore be driven forwards as a result of the advance of the box 6 and then taken over subsequently by the drive rollers 7.

It goes without saying that, to ensure smooth operation of the device, the assembly is dimensioned and designed in such a way that:

(a) the rear edge of the flexible frame 17 never comes any further than the front edge of the stack of sheets 2, in the most advanced position of the box 6, so as to prevent any risk that the rear of the frame 17 will be turned over in the phase of retraction of the box, which would make the device ineffective for the remaining operations, and (b) the front edge of the flexible frame 17 never comes beyond the feeder blade 4 on this side, in the most retracted position of the box, so as to avoid, in the event that insertion of the sheets is stopped, any risk that the front of the frame 17 will be turned over in the phase of advance of the box, which would in time damage the frame 17.

We claim:

1. A feed device for supplying sheets to a processing machine in which each sheet is fed from the bottom of a stack (2) delimited by a down stream abutment (4), comprising (a) at least one suction box (6) driven in a longitudinal to-and-fro movement and provided with a suction plate (10);

(b) at least one frame (17), made of flexible material, surrounding said suction plate (10) so as to form with it a hollow suction cup fixed in vertical position and having flexible edges (26) located above the upper level (21) of said plate (10) in the absence of a said sheet being sucked up, i.e., when said edges are raised, and located in alignment with or below said plate (10) when a sheet (22, 23) is sucked up, i.e., when said edges are turned down;

(c) said device being so dimensioned and arranged that a leading edge of said flexible frame (17) does not move, in the most retracted position of said suction box (6), beyond said downstream abutment (4).

2. A feed device according to claim 1, so dimensioned and arranged that a trailing edge of said flexible frame (17) does not move, in the most advanced position of said suction box (6), beyond the forward edge of said stack (2).

3. A feed device as claimed in claim 1, wherein said frame is composed of a coating made of plastic bonded to a cloth.

4. A feed device as claimed in claim 3, wherein said frame is fitted in such a way that the cloth side is directed towards the top.

* * * * *